US008679265B2

(12) United States Patent
Murakami et al.

(10) Patent No.: US 8,679,265 B2
(45) Date of Patent: Mar. 25, 2014

(54) HIGH-STRENGTH COLD-ROLLED STEEL SHEET

(75) Inventors: Toshio Murakami, Kobe (JP); Hideo Hata, Kobe (JP); Akira Ibano, Kobe (JP); Kenji Saito, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 409 days.

(21) Appl. No.: 12/742,323

(22) PCT Filed: Nov. 20, 2008

(86) PCT No.: PCT/JP2008/071142
§ 371 (c)(1),
(2), (4) Date: May 11, 2010

(87) PCT Pub. No.: WO2009/066734
PCT Pub. Date: May 28, 2009

(65) Prior Publication Data

US 2010/0252147 A1 Oct. 7, 2010

(30) Foreign Application Priority Data

Nov. 22, 2007 (JP) ..... 2007-303510
Nov. 22, 2007 (JP) ..... 2007-303511

(51) Int. Cl.
*C22C 38/00* (2006.01)
*C22C 38/22* (2006.01)
*C22C 38/08* (2006.01)

(52) U.S. Cl.
USPC ..... 148/332; 148/320; 148/333; 148/334; 148/336; 148/337

(58) Field of Classification Search
USPC ..... 148/320, 332, 333, 334, 336, 337
See application file for complete search history.

(56) References Cited

U.S. PATENT DOCUMENTS 7,090,731 B2 * 8/2006 Kashima et al. ..... 148/320
2004/0238082 A1 12/2004 Hasegawa et al.
2009/0277547 A1 11/2009 Saito et al.

FOREIGN PATENT DOCUMENTS

EP 1 637 618 A1 3/2006
JP 61-3843 1/1986

(Continued)

OTHER PUBLICATIONS

U.S. Appl. No. 13/257,639, filed Sep. 20, 2013, Hata, et al.

(Continued)

*Primary Examiner* — Keith Walker
*Assistant Examiner* — Alexander Polyansky
(74) *Attorney, Agent, or Firm* — Oblon, Spivak, McCelland, Maier & Neustadt, L.L.P.

(57) ABSTRACT

The invention provides a high-strength cold-rolled steel sheet which is improved in elongation and stretch-flangeability and exhibits more excellent formability. The high-strength cold-rolled steel sheet has a composition which contains by mass C: 0.03 to 0.30%, Si: 0.1 to 3.0%, Mn: 0.1 to 5.0%, P: 0.1% or below, S: 0.005% or below, N: 0.01% or below, and Al: 0.01 to 1.00% with the balance consisting of iron and unavoidable impurities. The high-strength cold-rolled steel sheet has a structure which comprises at least 40% (up to 100% inclusive) in terms of area fraction of tempered martensite having a hardness of 300 to 380 Hv and the balance ferrite. The cementite particles in the tempered martensite take such dispersion that 10 or more cementite particles having equivalent-circle diameters of 0.02 to less than 0.1 μm are present per one $\mu m^2$ of the tempered martensite and three or fewer cementite particles having equivalent-circle diameters of 0.1 μm or above are present per one $\mu m^2$ of the tempered martensite.

11 Claims, 3 Drawing Sheets

(56) References Cited

FOREIGN PATENT DOCUMENTS

| | | |
|---|---|---|
| JP | 62-99417 | 5/1987 |
| JP | 63-145718 | 6/1988 |
| JP | 6-93340 | 4/1994 |
| JP | 2002 161336 | 6/2002 |
| JP | 2004 18912 | 1/2004 |
| JP | 2004 232022 | 8/2004 |
| JP | 2004 256872 | 9/2004 |
| JP | 2005-256089 | 9/2005 |
| JP | 2005 256089 | 9/2005 |

OTHER PUBLICATIONS

U.S. Appl. No. 13/258,823, filed Sep. 22, 2011, Murakami, et al.

The Extended European Search Report issued Apr. 24, 2012, in Application No. /Patent No. 12000164.9-2122.

Extended European Search Report issued Jul. 6, 2011, in Patent Application No. 08851169.6.

U.S. Appl. No. 12/919,159, filed Aug. 24, 2010, Murakami, et al.

* cited by examiner

STEEL NO.2

STEEL NO.19

1 μm

HIGH-STRENGTH COLD-ROLLED STEEL SHEET

CROSS REFERENCES TO RELATED APPLICATIONS

This application is the U.S. National Stage of International Patent Application No. PCT/JP2008/071142, filed on Nov. 20, 2008, which claims priority to Japanese Patent Application No. 2007-303510, filed on Nov. 22, 2007, and Japanese Patent Application No. 2007-303511, filed Nov. 22, 2007.

TECHNICAL FIELD

The present invention relates to a high-strength steel sheet excellent in workability. The present invention relates more specifically to a high-strength steel sheet which is improved in elongation (total elongation) and stretch-flangeability or to a high-strength steel sheet which has small anisotropy of mechanical properties and is improved in elongation (total elongation) and stretch-flangeability.

BACKGROUND ART

In a steel sheet used for a skeleton part and the like for an automobile for example, high-strength is required aiming safety against collision and reduction of fuel consumption and the like by reducing the weight of the vehicle body, and excellent formability is also required in order to be worked to a skeleton part with a complicated shape.

Therefore, provision of a high-strength steel sheet with 780 MPa class or higher tensile strength and enhanced in both elongation (total elongation: El) and stretch-flangeability (hole expansion rate: $\lambda$) is strongly desired. For example, with respect to a steel sheet of 780 MPa class tensile strength, one with 15% or more total elongation and 100% or more hole expansion rate is required, whereas with respect to a steel sheet of 980 MPa class tensile strength, one with 10% or more total elongation and 100% or more hole expansion rate is desired.

Further, one having smallest possible anisotropy (less than 1%, for example) of elongation (difference between the elongation in the rolling direction and that in the direction orthogonal to the rolling direction) is also desired.

In order to meet the needs described above, a lot of high-strength steel sheets with improved balance of elongation and stretch-flangeability have been proposed based on a variety of ways of thinking on structure control. However, the current situation is that the one in which both of elongation and stretch-flangeability are compatibly secured so as to satisfy the desired level described above has not been successfully completed yet.

For example, in the Patent Document 1, a high-strength cold-rolled steel sheet containing at least one kind of Mn, Cr and Mo by 1.6-2.5 mass % in total and composed essentially of a single phase structure of martensite is disclosed. However, in the high-strength cold-rolled steel sheet disclosed in the Patent Document 1, although 100% or more of the hole expansion rate (stretch-flangeability) is secured, the elongation does not reach 10% (refer to an example of the invention in Table 6 of the document).

Also, in the Patent Document 2, a high-strength steel sheet composed of a two phase structure including 65-85% in terms of area fraction of ferrite with the balance of tempered martensite is disclosed.

Further, in the Patent Document 3, a high-strength steel sheet composed of a two phase structure in which both of the average grain size of ferrite and martensite are 2 μm or less and the volume ratio of martensite is 20% or more and less than 60% is disclosed.

In both of the high-strength steel sheet disclosed in the Patent Documents 2 and 3, 10% or more elongation is secured however the hole expansion rate (stretch-flangeability) does not reach 100% (refer to the example of the invention of Table 2 of the Patent Document 2 and the example of Table 2 of the Patent Document 3).

Also, none of the Patent Documents 1 to 3 mentions on anisotropy of elongation.

[Patent Document 1] Japanese Published Unexamined Patent Application No. 2002-161336

[Patent Document 2] Japanese Published Unexamined Patent Application No. 2004-256872

[Patent Document 3] Japanese Published Unexamined Patent Application No. 2004-232022

DISCLOSURE OF THE INVENTION

Problems to be Solved by the Invention

A first object of the present invention is to provide a high-strength cold-rolled steel sheet enhanced in both elongation and stretch-flangeability and more excellent in formability.

Also, a second object of the present invention is to provide a high-strength cold-rolled steel sheet enhanced in both elongation and stretch-flangeability, lowered with respect to anisotropy of elongation also, and more excellent in formability.

Means for Solving the Problems

The steel sheet according to a first aspect of the present application is a high-strength cold-rolled steel sheet having a componential composition containing:

C: 0.03-0.30 mass %,
Si: 0.1-3.0 mass %,
Mn: 0.1-5.0 mass %,
P: 0.1 mass % or below,
S: 0.005 mass % or below,
N: 0.01 mass % or below,
Al: 0.01-1.00 mass %, with the balance consisting of iron and unavoidable impurities, in which a structure comprises at least 40% (up to 100% inclusive) in terms of area fraction of tempered martensite having a hardness of 300 to 380 Hv with the balance being ferrite; and cementite particles in the tempered martensite take such dispersion that:

10 or more cementite particles having equivalent-circle diameters of 0.02 μm or more and less than 0.1 μm are present per one $\mu m^2$ of the tempered martensite; and three or fewer cementite particles having equivalent-circle diameters of 0.1 μm or above are present per one $\mu m^2$ of the tempered martensite. With these constitutions, the steel sheet according to the first aspect becomes a steel sheet excellent in both elongation and stretch-flangeability.

Also, the steel sheet according to a second aspect of the present application is a high-strength cold-rolled steel sheet having a componential composition containing:

C: 0.03-0.30 mass %,
Si: 0.1-3.0 mass %,
Mn: 0.1-5.0 mass %,
P: 0.1 mass % or below,
S: 0.005 mass % or below, N: 0.01 mass % or below, Al: 0.01-1.00 mass %, with the balance consisting of iron and unavoidable impurities, in which a structure comprises at least 40% (up to 100% inclusive) in terms of area fraction of tempered martensite having a hardness of 300 to 380 Hv with the balance being ferrite;

cementite particles in the tempered martensite take such dispersion that three or fewer cementite particles having equivalent-circle diameters of 0.1 μm or above are present per one $\mu m^2$ of the tempered martensite; and the maximum degree of integration of (110) crystal plane in the ferrite is 1.7 or less. With these constitutions, the steel sheet according to the second aspect becomes a steel sheet excellent in isotropy as well as elongation and stretch-flangeability.

It is preferable that the steel sheet according to the first aspect or the second aspect further comprises:

Cr: 0.01-1.0 mass % and/or Mo: 0.01-1.0 mass %.

It is preferable that the steel sheet described above further comprises:

Cu: 0.05-1.0 mass % and/or Ni: 0.05-1.0 mass %.

It is preferable that the steel sheet described above further comprises:

Ca: 0.0005-0.01 mass % and/or Mg: 0.0005-0.01 mass %.

Effects of the Invention

In the steel sheet according to the first aspect of the present application, in the two phase structure composed of the ferrite and the tempered martensite, the hardness and the area fraction of the tempered martensite and the dispersion state of the cementite particles in the tempered martensite are appropriately controlled. Thereby, in the steel sheet according to the first aspect of the present invention, it became possible to improve the stretch-flangeability while securing the elongation, and it became possible to provide a high-strength steel sheet more excellent in formability.

In the steel sheet according to the second aspect of the present application, in the two phase structure composed of the ferrite and the tempered martensite, the hardness and the area fraction of the tempered martensite, the dispersion state of the cementite particles in the tempered martensite and the degree of integration of (110) crystal plane in the ferrite are appropriately controlled. Thereby, in the steel sheet according to the second aspect, it became possible to improve stretch-flangeability while securing the elongation and to reduce anisotropy of elongation, and it became possible to provide a high-strength steel sheet more excellent in formability.

BEST MODE FOR CARRYING OUT THE INVENTION

Figure 1:
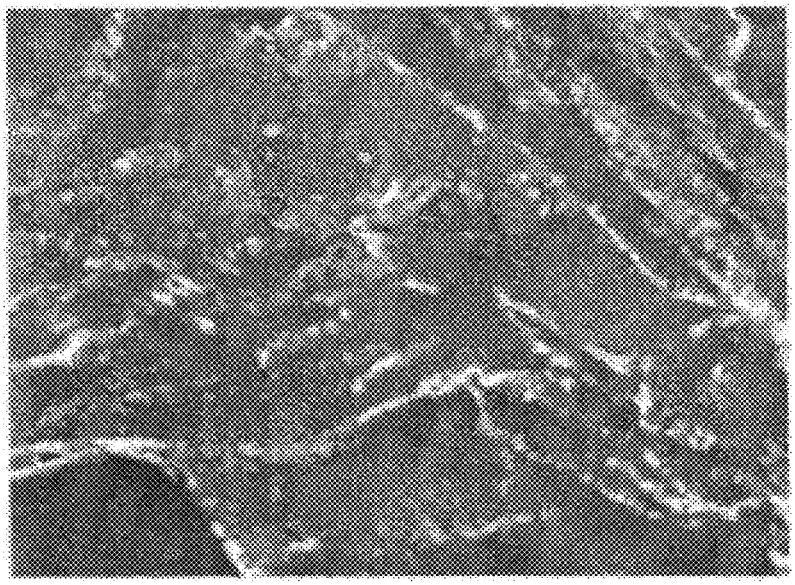
FIG. 1 A drawing showing the dispersion state of the cementite particles in the martensite structure of an example of the invention (steel No. 2) of an embodiment related with the steel sheet according to the first aspect of the present application and a comparative example (steel No. 19).
Figure 1:
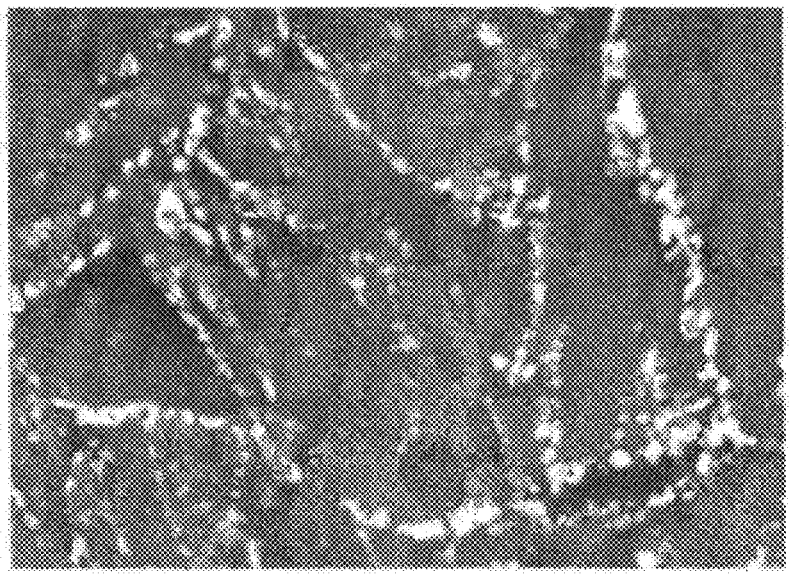

The present inventors watched the high-strength steel sheet having the two phase structure composed of the ferrite and the tempered martensite (hereinafter simply referred to as "martensite") (refer to the Patent Documents 2, 3). Further, the present inventors considered that a high-strength steel sheet that could satisfy the desired level described above could be secured if stretch-flangeability could be improved while securing the elongation, and have carried out intensive investigations such as studying the influence of a variety of factors affecting stretch-flangeability. As a result, it was found out that stretch-flangeability could be improved by lowering the hardness of the tempered martensite and miniaturizing the cementite particles precipitated in the martensite in tempering in addition to reducing the ratio of the ferrite, and the steel sheet according to the first aspect of the present application came to be completed based on the knowledge.

Further, in addition to the knowledge described above, the present inventors found out that the difference between the elongation in the rolling direction and that in the direction orthogonal to the rolling direction could be reduced by limiting the degree of integration of (110) crystal plane of the ferrite to a predetermined value or less, and the second aspect of the present application came to be completed based on the knowledge.

(1) First Aspect

Below, the structure featuring the steel sheet according to the first aspect of the present application will be described.

(Structure of the Steel Sheet of the First Aspect]

As described above, the steel sheet according to the first aspect is on the basis of the two-phase structure (ferrite+tempered martensite) similar to those in the Patent Documents 2, 3, however it is different from the steel sheet described in the Patent Documents 2, 3 particularly in terms that the hardness of the tempered martensite is controlled to 300-380 Hv and that the dispersion state of the cementite particles precipitated in the tempered martensite is controlled.

<Tempered Martensite with 300-380 Hv Hardness: 40% or More (Up to 100% Inclusive) in Terms of Area Fraction>

By limiting the hardness of the tempered martensite and enhancing the deformability of the tempered martensite, the stress concentration to the interface of ferrite and the tempered martensite can be inhibited, generation of a crack in the interface can be prevented, and stretch-flangeability can be secured. Also, high-strength can be secured even if the hardness of the tempered martensite is reduced by making the hardness of the tempered martensite 300 Hv or more and securing 40% or more in terms of the area fraction.

In order to exert the actions described above effectively, the hardness of the tempered martensite is made 380 Hv or less (preferably 370 Hv or less, more preferably 350 Hv or less). Also, the tempered martensite is made 40% or more in terms of the area fraction, preferably 50% or more, more preferably 60% or more, further more preferably 70% or more (up to 100% inclusive). Further, the balance is ferrite.

<Cementite Particles Having Equivalent-Circle Diameters of 0.02 μm or More and Less than 0.1 μm: 10 or More Per One $\mu m^2$ of Tempered Martensite; Cementite Particles Having Equivalent-Circle Diameters of 0.1 μm or More: 3 or Fewer Per One $\mu m^2$ of the Tempered Martensite>

By controlling the size and the number of existence of the cementite particles precipitated in the martensite in tempering, both of elongation and stretch-flangeability can be improved. That is, by dispersing the appropriately fine cementite particles in the martensite in much quantity and letting them work as the proliferation sources of dislocation, a work hardening exponent can be increased which contributes to improvement of elongation. Also, by reducing the number of coarse cementite particles which become the starting points of breakage in stretch-flanging deformation, stretch-flangeability can be improved.

In order to exert the actions described above effectively, the number of the appropriately fine cementite particles having equivalent-circle diameters of 0.02 μm or more and less than 0.1 μm present per one $\mu m^2$ of the tempered martensite is made 10 or more, preferably 15 or more, more preferably 20 or more. The number of the coarse cementite particles having equivalent-circle diameters of 0.1 μm or more present per one $\mu m^2$ of the tempered martensite is limited to 3 or less, preferably 2.5 or less, more preferably 2 or less.

Also, the reason the lower limit of the equivalent-circle diameters of the appropriately fine cementite particles described above is made 0.02 μm is that the cementite particles finer than this size cannot impart sufficient strain to the crystal structure of the martensite, and are considered to hardly contribute as the proliferation sources of dislocation.

Below, the measurement method for the hardness and the area fraction of the tempered martensite and the size and the number of existence of the cementite particles will be described.

First, with respect to the area fraction of the martensite, each sample steel sheet was mirror-finished, was corroded by 3% nital liquid to expose the metal structure, thereafter scanning electron microscope (SEM) images of 20,000 magnifications were observed with respect to five fields of view of approximately 4 μm×3 μm regions, the region not including cementite was regarded to be the ferrite by an image analysis, the remainder region was regarded to be the martensite, and the area fraction of the martensite was calculated from the area ratio of each region.

Figure 2:
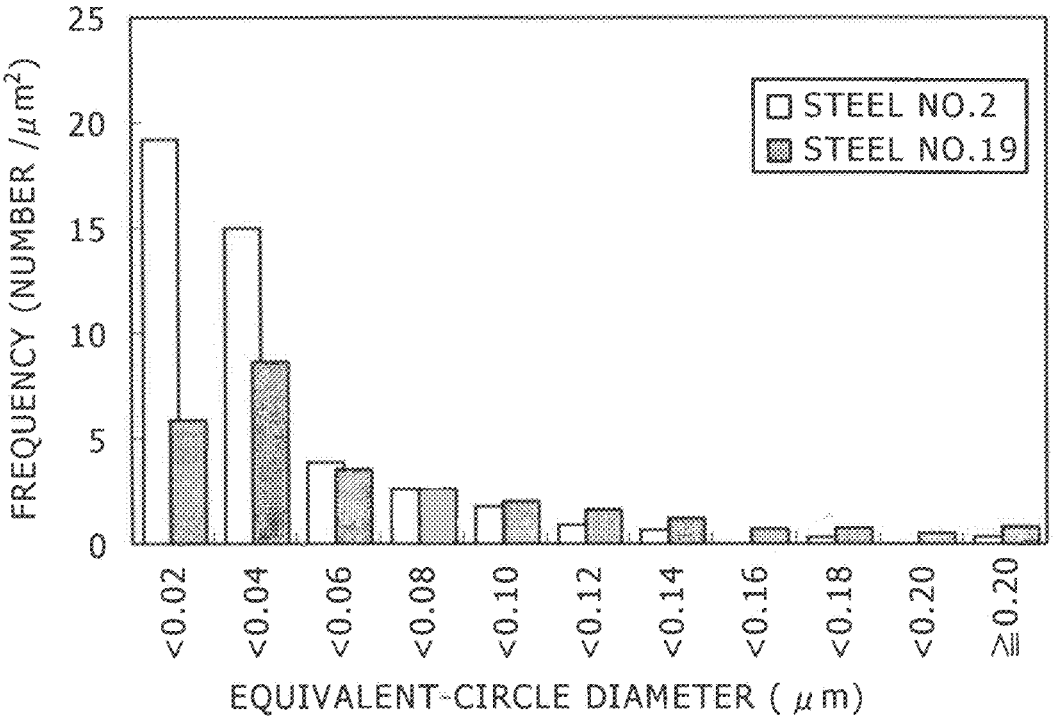
FIG. 2 A graph showing the grain size distribution of the cementite particles in the martensite structure of an example of the invention (steel No. 2) of an embodiment related with the steel sheet according to the first aspect of the present application and a comparative example (steel No. 19).

Next, with respect to the hardness of the martensite, the Vickers hardness (98.07N) Hv of the surface of each sample steel sheet was measured according to the test method of JIS Z 2244, and was converted to the hardness of the martensite HvM using the equation (1) below.

$$\mathrm{Hv}M=(100\times\mathrm{Hv}-VF\times\mathrm{Hv}F)/VM \qquad \text{equation (1)}$$

where HvF=102+209[% P]+27[% Si]+10[% Mn]+4[% Mo]−10[% Cr]+12[% Cu] (From FIG. 2.1 in page 10 of Pickering, F. B., translated by Fujita, Toshio et al. "Tekkou zairyou-no sekkei-to riron" (Physical Metallurgy and the Design of Iron and Steels) Maruzen Co., Ltd., issued on Sep. 30, 1981, degree of influence (inclination of a straight line) of the quantity of each alloy element affecting the variation of the proof stress of low C ferritic steel was read and formulated. In this regard, other elements such as Al and N were deemed not to affect the hardness of the ferrite.)

Here, HvF: the hardness of the ferrite, VF: the area fraction (%) of the ferrite, VM: the area fraction (%) of the martensite, [% X]: the content (mass %) of a componential element X.

With respect to the size and the number of existence of the cementite particles, each sample steel sheet was mirror-finished, was corroded by 3% nital liquid to expose the metal structure, and thereafter a scanning electron microscope (SEM) image of 10,000 magnifications was observed with respect to a field of view of 100 $\mu m^2$ region so as to analyze the region inside the martensite. Further, white parts were judged to be the cementite particles from the contrast of the image and were marked, the equivalent-circle diameters were calculated from the area of the each cementite particle marked by image analyzing software, and the number of the cementite particles of a predetermined size present per a unit area was secured.

(2) Second Aspect

Next, the structure featuring the steel sheet according to the second aspect of the present application will be described.

(Structure of the Steel Sheet of the Second Aspect]

Similar to the steel sheet according to the first aspect, in the steel sheet according to the second aspect, the hardness of the tempered martensite is controlled to 300-380 Hv and the dispersion state of the cementite particles precipitated in the tempered martensite is controlled. Further, the maximum degree of integration of (110) crystal plane in ferrite is controlled, which is different from the case of the steel sheet according to the first aspect.

<Tempered Martensite with 300-380 Hv Hardness: 40% or More (Up to 100% Inclusive) in Terms of Area Fraction>

By limiting the hardness of the tempered martensite and enhancing the deformability of the tempered martensite, the stress concentration to the interface of the ferrite and the tempered martensite can be inhibited, generation of a crack in the interface can be prevented, and stretch-flangeability can be secured. Also, high-strength can be secured even if the hardness of the tempered martensite is reduced by making the hardness of the tempered martensite 300 Hv or more and securing 40% or more in terms of the area fraction.

In order to exert the actions described above effectively, the hardness of the tempered martensite is made 380 Hv or less (preferably 370 Hv or less, more preferably 350 Hv or less). Also, the tempered martensite is made 40% or more in terms of the area fraction, preferably 50% or more, more preferably 60% or more, further more preferably 70% or more (up to 100% inclusive). Further, the balance is ferrite.

<Cementite Particles Having Equivalent-Circle Diameters of 0.1 μm or More: 3 or Fewer Per One $\mu m^2$ of Tempered Martensite>

By controlling the size and the number of existence of the cementite particles precipitated in the martensite in tempering, stretch-flangeability can be improved. That is, by reducing the number of the coarse cementite particles which become the starting points of breakage in stretch-flanging deformation, stretch-flangeability can be improved. Thus, with the cementite particles being prevented from becoming coarse, the cementite particles of an appropriate size (for example, 0.02 μm or more and less than 0.1 μm) are dispersed into the martensite, and therefore a work hardening exponent increases as the cementite particles work as the proliferation sources of dislocation, which contributes also to improvement of elongation.

In order to exert the actions described above effectively, the number of the coarse cementite particles having equivalent-circle diameters of 0.1 μm or more present per one $\mu m^2$ of the tempered martensite is limited to 3 or less, preferably 2.5 or less, more preferably 2 or less.

<The Maximum Degree of Integration of (110) Crystal Plane in Ferrite is 1.7 or Less>

When (110) crystal planes (hereinafter referred to as "(110)α") in the ferrite integrate excessively in a specific direction, a sliding system that acts when a stress is applied changes between the specific direction and a direction in which the (110) crystal planes do not integrate much, and therefore difference in elongation occurs according to the direction of the tensile load. Consequently, by controlling the degree of integration of (110) crystal plane in the ferrite, anisotropy of the mechanical properties, elongation (El) in particular, can be reduced.

In order to effectively exert the anisotropy inhibiting effect, the maximum degree of integration of (110) crystal plane in the ferrite is made 1.7 or less, preferably 1.6 or less, more preferably 1.5 or less.

The measurement method for the hardness and the area fraction of the tempered martensite and the size and the number of existence of the cementite particles is same with that in the case of the first aspect.

With respect to the degree of integration of the (110) crystal plane in ferrite, a pole figure of the (110) crystal plane in the ferrite was drawn according to the FM method described in p. 465 of The Iron and Steel Institute of Japan. "Hagane binran I, kiso" (Iron and Steel Handbook, Vol. I, Basic). 3rd ed., Maruzen Co., Ltd., and the maximum value of the pole density was made the degree of integration.

Next, the componential composition composing the steel sheet according to the first aspect and the steel sheet according to the second aspect of the present application (which is common to both the aspects) will be described. All of the units of the chemical components below are % in mass.

[Componential Composition of the Steel Sheet According to an Aspect of the Present Invention]

C: 0.03-0.30%

C is an important element affecting the area fraction of the martensite and the quantity of the cementite precipitated in the martensite, and affecting the strength and stretch-flangeability. If C content is below 0.03%, the strength cannot be secured, whereas if C content exceeds 0.30%, the hardness of the martensite becomes excessively high and stretch-flangeability cannot be secured. The range of C content is preferably 0.05-0.25%, more preferably 0.07-0.20%.

Si: 0.1-3.0%

Si has an effect of inhibiting coarsening of the cementite particles in tempering and is a useful element contributing to co-existence of elongation and stretch-flangeability by increasing the number of the appropriately fine cementite particles while preventing formation of the coarse cementite particles. When Si content is less than 0.10%, the increase rate of the coarse cementite particles in tempering becomes excessive against the increase rate of the appropriately fine cementite particles, and therefore elongation and stretch-flangeability cannot co-exist. On the other hand, when Si content exceeds 3.0%, formation of the austenite is inhibited in heating, therefore the area fraction of the martensite cannot be secured, and stretch-flangeability cannot be secured. The range of Si content is preferably 0.30-2.5%, more preferably 0.50-2.0%.

Mn: 0.1-5.0%

Similar to Si described above, Mn has an effect of inhibiting coarsening of the cementite particles in tempering and is a useful element contributing to co-existence of elongation and stretch-flangeability and securing quenchability by increasing the number of the appropriately fine cementite particles while preventing formation of the coarse cementite particles. When Mn content is below 0.1%, the increase rate of the coarse cementite particles in tempering becomes excessive against the increase rate of the appropriately fine cementite particles, and therefore elongation and stretch-flangeability cannot co-exist, whereas when Mn content exceeds 5.0%, the austenite remains in quenching (in cooling after heating for annealing), and stretch-flangeability is deteriorated. The range of Mn content is preferably 0.30-2.5%, more preferably 0.50-2.0%.

P: 0.1% or below

P is unavoidably present as an impurity element and contributes to increase of the strength by solid solution strengthening, however it is segregated on old austenite grain boundaries and makes the boundaries brittle, thereby deteriorates stretch-flangeability. P content is therefore made 0.1% or below, preferably 0.05% or below, more preferably 0.03% or below.

S: 0.005% or below

S also is unavoidably present as an impurity element and deteriorates stretch-flangeability because it forms MnS inclusions and becomes a starting point of a crack in hole expansion. S content is therefore made 0.005% or below, more preferably 0.003% or below.

N: 0.01% or below

N also is unavoidably present as an impurity element and deteriorates elongation and stretch-flangeability by strain ageing; therefore, N content preferably is to be low and is made 0.01% or below.

Al: 0.01-1.00%

Al prevents deterioration of stretch-flangeability by joining with N to form AlN and reducing solid-soluble N which contributes to causing strain ageing and contributes to improvement of the strength by solid solution strengthening. When Al content is below 0.01%, solid-soluble N remains in steel, therefore strain ageing occurs and elongation and stretch-flangeability cannot be secured, whereas when Al content exceeds 1.00%, formation of the austenite in heating is inhibited, therefore area fraction of the martensite cannot be secured, and it becomes impossible to secure stretch-flangeability.

The steel sheet according to an aspect of the present invention basically contains the components described above and the balance substantially is iron and impurities, however other allowable components described below can be added within the scope not impairing the actions of the present invention.

Cr: 0.01-1.0% and/or Mo: 0.01-1.0%

These elements are useful elements in increasing a precipitation strengthening quantity while inhibiting deterioration of stretch-flangeability by precipitating as fine carbide in stead of the cementite. When added by less than 0.01%, both elements cannot effectively exert such actions as described above. On the other hand, when both elements are added exceeding 1.0%, precipitation strengthening becomes excessive, the hardness of the martensite becomes excessively high, and stretch-flangeability deteriorates.

Cu: 0.05-1.0% and/or Ni: 0.05-1.0%

These elements are useful elements in improving the balance of elongation and stretch-flangeability because the appropriately fine cementite comes to be easily secured by inhibiting growth of the cementite. When added by below 0.05%, both elements cannot effectively exert such actions as described above. On the other hand, when both elements are added exceeding 1.0%, the austenite remains in quenching, and stretch-flangeability is deteriorated.

Ca: 0.0005-0.01% and/or Mg: 0.0005-0.01%

These elements are useful elements in improving stretch-flangeability by miniaturizing the inclusions and reducing the starting point of breakage. When added by below 0.0005%, both elements cannot effectively exert the actions described above. On the other hand, when added exceeding 0.01%, the inclusions become coarse to the contrary and stretch-flangeability deteriorates.

Below, a preferable method of manufacturing for securing a steel sheet according to the first aspect of the present application will be described.

[Preferable Method of Manufacturing of a Steel Sheet According to the First Aspect]

In order to manufacture a cold rolled steel sheet according to the first aspect, first, steel having the componential composition described above is smelted, is made a slab by ingot-making or continuous casting, and is thereafter hot-rolled. Hot rolling condition is to set the finishing temperature in the finishing rolling to $Ar_3$ point or above, to perform cooling properly, and to perform winding thereafter at a range of 450-700° C. After hot rolling is finished, cold rolling is performed after acid washing, but it is preferable to make the reduction ratio of cold rolling approximately 30% or more.

Then, after the above-referenced cold rolling, annealing and tempering are performed in succession.

[Annealing Condition]

With respect to the annealing condition, it is preferable to perform heating with the annealing heating temperature: [(Ac1+Ac3)/2] to 1,000° C., to maintain by the annealing holding time: 3,600 s or below, and thereafter either to perform rapid cooling at a cooling rate of 50° C./s or more from the annealing heating temperature down to a temperature of Ms point or below directly, or to perform slow cooling with a cooling rate of 1° C./s or more (a first cooling rate) from the annealing heating temperature down to a temperature below the annealing heating temperature and 600° C. or above (the finishing temperature of a first cooling) and thereafter to perform rapid cooling at a cooling rate of 50° C./s or less (a second cooling rate) down to the temperature of Ms point or below (the finishing temperature of a second cooling).

<Annealing Heating Temperature: [(Ac1+Ac3)/2] to 1,000° C., Annealing Holding Time: 3,600 s or Below>

This condition was established in order to realize sufficient transformation to the austenite in heating of annealing and to secure 50% or more of the area fraction of the martensite formed by transformation from the austenite in cooling thereafter.

When the annealing heating temperature is below [(Ac1+Ac3)/2]° C., the amount of transformation to the austenite is not sufficient in heating for annealing, therefore the amount of the martensite formed by transformation from the austenite in cooling thereafter decreases, and it becomes impossible to secure the area fraction of 40% or more. On the other hand, when the annealing heating temperature exceeds 1,000° C., the austenite structure becomes coarse, bending performance and toughness of the steel sheet deteriorate and annealing facilities are deteriorated, which is not preferable.

Also, when the annealing holding time exceeds 3,600 s, productivity deteriorates extremely, which is not preferable.

<Rapid Cooling at a Cooling Rate of 50° C./s or More Down to a Temperature of Ms Point or Below>

This condition was established in order to inhibit formation of the ferrite and the bainite structure from the austenite in cooling and to secure the martensite structure.

When the rapid cooling is finished at a temperature higher than Ms point or the cooling rate is less than 50° C./s, the bainite comes to be formed and it becomes impossible to secure the strength of the steel sheet.

<Slow Cooling with a Cooling Rate of 1° C./s or More Down to a Temperature Below the Heating Temperature and 600° C. or Above>

This condition was established in order to enable improvement of elongation while securing stretch-flangeability by forming the ferrite structure of the area fraction of 60% or less.

When the temperature is below 600° C. or the cooling rate is less than 1° C./s, ferrite is not formed, and it becomes impossible to secure strength and stretch-flangeability.

[Tempering Condition]

The tempering condition can be to perform heating at an average heating rate of 5° C./s or more for the temperature difference of 100-325° C. from the temperature after annealing and cooling described above to the tempering heating temperature of a first step: 325-375° C., to hold for the tempering holding time of the first step: 50 s or more, thereafter to heat further up to a tempering heating temperature of a second step T: 400° C. or above, to hold under the condition that the tempering holding time of the second step t(s) becomes $3.2\times10^{-4}<P=\exp[-9649/(T+273)]\times t<1.2\times10^{-3}$, thereafter to perform cooling. Also when the temperature T is to be changed during holding of the second step, the equation (2) below can be used.

$$P=\int_0^t \exp\left(-\frac{9649}{(T(t)+273)}\right)\cdot dt \qquad \text{equation (2)}$$

The reason the procedure described above was established is that the cementite particles can be grown to a proper size by performing holding in the vicinity of 350° C. which is in a temperature range where precipitation of the cementite from the martensite becomes most quick, evenly precipitating the cementite particles in the martensite structure, and thereafter performing heating up to a higher temperature range and holding.

<Heating at an Average Heating Rate of 5° C./s or More for the Temperature Difference of 100-325° C. Up to the Tempering Heating Temperature of the First Step: 325-375° C.>

When the heating temperature for tempering of the first step is below 325° C. or above 375° C., or the average heating rate for the temperature difference of 100-325° C. is less than 5° C./s, precipitation of the cementite particles occurs unevenly in the martensite, therefore ratio of the coarse cementite particles increases because of the growth during heating and holding of the second step thereafter, and it becomes impossible to secure stretch-flangeability.

<Heating Up to the Tempering Heating Temperature of the Second Step T: 400° C. or Above, and Holding Under the Condition that the Tempering Holding Time of the Second Step t(s) Becomes $3.2\times10^{-4}<P=\exp[-9649/(T+273)]\times t<1.2\times10^{-3}$>

Here, $P=\exp[-9649/(T+273)]\times t$ is a parameter deciding the size of the cementite particle as a precipitated object where setting of variables and simplification were performed based on the particle growth model of the precipitated object described in the equation (4.18) in P. 106 of Sugimoto, Koichi, et al. "Zairyou soshikigaku (study of material structure)", Asakura Publishing Co., Ltd.

When the tempering heating temperature of the second step T is made below 400° C., the holding time t required for growing the cementite particles to a sufficient size becomes too long.

When $P=\exp[-9649/(T+273)]\times t\leq3.2\times10^{-4}$, the cementite particles do not grow sufficiently, the number of the appropriately fine cementite particles cannot be secured, and therefore it becomes impossible to secure elongation.

When $P=\exp[-9649/(T+273)]\times t\geq1.2\times10^{-3}$, the cementite particles become coarse and the number of the cementite particles of 0.1 μm or above becomes too many, and therefore it becomes impossible to secure stretch-flangeability.

Next, a preferable method of manufacturing of securing a steel sheet according to the second aspect of the present application will be described.

[Preferable Method of Manufacturing for a Steel Sheet According to the Second Aspect]

In order to manufacture a cold rolled steel sheet according to the second aspect, first, steel having the componential composition described above is smelted, is made a slab by ingot-making or continuous casting, and is thereafter hot-rolled. Hot rolling condition is to set the finishing temperature in the finishing rolling to $Ar_3$ point or above, to perform cooling properly, and to perform winding thereafter at a range of 450-700° C. After hot rolling is finished, cold rolling is performed after acid washing, but it is preferable to make the reduction ratio of cold rolling approximately 30% or more.

Then, after the above-referenced cold rolling, annealing, reannealing and tempering are performed in succession.

[Annealing Condition]

The annealing condition is to perform heating up to Ac3 point or above (may perform heating up to Ac3 point or above repeating two times or more according to necessity), to sufficiently perform conversion of the austenite into single phase, and thereafter to perform cooling down to 200° C. or below. The cooling method may be selected arbitrarily. Thus, integration of (110) crystal planes of ferrite in a specific direction is inhibited.

[Reannealing Condition]

With respect to the reannealing condition, it is preferable to perform heating with the reannealing heating temperature: [(Ac1+Ac3)/2] to 1,000° C., to maintain by the reannealing holding time: 3,600 s or below, and thereafter either to perform rapid cooling at a cooling rate of 50° C./s or more from the reannealing heating temperature down to a temperature of Ms point or below directly, or to perform slow cooling with a cooling rate of 1° C./s or more (the first cooling rate) from the reannealing heating temperature down to a temperature below the reannealing heating temperature and 600° C. or above (the finishing temperature of the first cooling) and thereafter to perform rapid cooling at a cooling rate of 50° C./s or less (the second cooling rate) down to the temperature of Ms point or below (the finishing temperature of the second cooling).

<Reannealing Heating Temperature: [(Ac1+Ac3)/2] to 1,000° C., Reannealing Holding Time: 3,600 s or Less>

This condition was established in order to realize sufficient transformation to the austenite in heating of reannealing and to secure 40% or more of the area fraction of the martensite formed by transformation from the austenite in cooling thereafter.

When the reannealing heating temperature is below [(Ac1+Ac3)/2]° C., the amount of transformation to the austenite is not sufficient in heating for reannealing, therefore the amount of the martensite formed by transformation from the austenite in cooling thereafter decreases, and it becomes impossible to secure the area fraction of 40% or more. On the other hand, when the reannealing heating temperature exceeds 1,000° C., the austenite structure becomes coarse, bending performance and toughness of the steel sheet deteriorate and annealing facilities are deteriorated, which is not preferable.

Also, when the reannealing holding time exceeds 3,600 s, productivity deteriorates extremely, which is not preferable.

<Rapid Cooling at a Cooling Rate of 50° C./s or More Down to a Temperature of Ms Point or Below>

This condition was established in order to inhibit formation of the ferrite and the bainite structure from the austenite in cooling and to secure the martensite structure.

When the rapid cooling is finished at a temperature higher than Ms point or the cooling rate is less than 50° C./s, the bainite comes to be formed and it becomes impossible to secure the strength of the steel sheet.

<Slow Cooling with a Cooling Rate of 1° C./s or More Down to a Temperature Below the Reannealing Heating Temperature and 600° C. or Above>

This condition was established in order to enable improvement of elongation while securing stretch-flangeability by forming the ferrite structure of the area fraction of 60% or less.

When the temperature is below 600° C. or the cooling rate is less than 1° C./s, ferrite is not formed, and it becomes impossible to secure strength and stretch-flangeability.

[Tempering Condition]

The tempering condition can be to perform heating at an average heating rate of 5° C./s or more for the temperature difference of 100-325° C. from the temperature after reannealing and cooling described above up to the tempering heating temperature of the first step: 325-375° C., to hold for the tempering holding time of the first step: 50 s or more, thereafter to heat further up to a tempering heating temperature of the second step T: 400° C. or above, to hold under the condition that the tempering holding time of the second step t(s) becomes $Pg=\exp[-9649/(T+273)]\times t<1.2\times10^{-3}$ and $Pt=(T+273)[\log(t)+17]\geq1.36\times10^{4}$, thereafter to perform cooling. Also when the temperature T is to be changed during holding of the second step, the equation (2) described above can be used as Pg.

The reason the procedure described above was established is that the cementite particles can be grown to a proper size by performing holding in the vicinity of 350° C. which is in a temperature range where precipitation of the cementite from the martensite becomes most quick, evenly precipitating the cementite particles in martensite structure, and thereafter performing heating up to a higher temperature range and holding.

<Heating at an Average Heating Rate of 5° C./s or More for the Temperature Difference of 100-325° C. Up to the Tempering Heating Temperature of the First Step: 325-375° C.>

When the heating temperature for tempering of the first step is below 325° C. or above 375° C., or when the average heating rate for the temperature difference of 100-325° C. is less than 5° C./s, precipitation of the cementite particles occurs unevenly in the martensite, therefore ratio of the coarse cementite particles increases because of the growth during heating and holding of the second step thereafter, and it becomes impossible to secure stretch-flangeability.

<Heating Up to the Tempering Heating Temperature of the Second Step T: 400° C. or Above, and Holding Under the Condition that the Tempering Holding Time of the Second Step t(s) Becomes $Pg=\exp[-9649/(T+273)]\times t<1.2\times10^{-3}$ and $Pt=(T+273)[\log(t)+17]\geq1.36\times10^{4}$>

Here, $Pg=\exp[-9649/(T+273)]\times t$ is a parameter deciding the size of the cementite particle as a precipitated object where setting of variables and simplification were performed based on the particle growth model of the precipitated object described in the equation (4.18) in p. 106 of Sugimoto, Koichi, et al. "Zairyou soshikigaku (study of material structure)", Asakura Publishing Co, Ltd.

Also, $Pt=(T+273)[\log(t)+17]$ is a parameter deciding the hardness of the tempered martensite described in p. 50 of "Tekkou zairyou, Kouza•Gendai-no kinzokugaku, Zairyou-hen 4 (course: metallurgy in modern times, book of materials, vol. 4, iron and steel material)" edited by The Japan Institute of Metals.

When the tempering heating temperature of the second step T is made below 400° C., the holding time t required for growing the cementite particles to an appropriate size becomes too long.

When $Pg=\exp[-9649/(T+273)]\times t\geq 1.2\times 10^{-3}$, the cementite particles become coarse, the number of the cementite particles of 0.1 μm or above becomes too many, and therefore it becomes impossible to secure stretch-flangeability.

Also, when $Pt=(T+273)[\log(t)+17]<1.36\times 10^{4}$, the hardness of the martensite is not lowered sufficiently, and stretch-flangeability cannot be secured.

Embodiment

Embodiment Related to a Steel Sheet of a First Aspect

Steel with the components shown in Table 1 below was smelted, and an ingot with 120 mm thickness was manufactured. It was hot rolled to the thickness of 25 mm, and thereafter was hot rolled again to the thickness of 3.2 mm. It was acid washed, was cold rolled thereafter to the thickness of 1.6 mm to make the sample material, and was subjected to heat treatment under the condition shown in Table 2.

TABLE 1

(mass %)

| Steel kind | C | Si | Mn | P | S | N | Al | Cr | Mo | Cu | Ni | Ca | Mg |
|---|---|---|---|---|---|---|---|---|---|---|---|---|---|
| A | 0.15 | 0.10 | 2.00 | 0.001 | 0.002 | 0.0040 | 0.030 | — | — | — | — | — | — |
| B | 0.15 | 1.20 | 2.00 | 0.001 | 0.002 | 0.0040 | 0.030 | — | — | — | — | 0.0010 | — |
| D | 0.01 | 1.20 | 2.00 | 0.001 | 0.002 | 0.0040 | 0.030 | — | — | — | — | 0.0010 | — |
| E | 0.25 | 1.20 | 2.00 | 0.001 | 0.002 | 0.0040 | 0.030 | — | — | — | — | 0.0010 | — |
| F | 0.40* | 1.20 | 2.00 | 0.001 | 0.002 | 0.0040 | 0.030 | — | — | — | — | 0.0010 | — |
| G | 0.15 | 2.00 | 2.00 | 0.001 | 0.002 | 0.0040 | 0.030 | — | — | — | — | 0.0010 | — |
| H | 0.15 | 3.00 | 2.00 | 0.001 | 0.002 | 0.0040 | 0.030 | — | — | — | — | 0.0010 | — |
| I | 0.15 | 1.20 | 0.05* | 0.001 | 0.002 | 0.0040 | 0.030 | — | — | — | — | 0.0010 | — |
| J | 0.15 | 1.20 | 1.20 | 0.001 | 0.002 | 0.0040 | 0.030 | — | — | — | — | 0.0010 | — |
| K | 0.15 | 1.20 | 3.00 | 0.001 | 0.002 | 0.0040 | 0.030 | — | — | — | — | 0.0010 | — |
| L | 0.15 | 1.20 | 6.00* | 0.001 | 0.002 | 0.0040 | 0.030 | — | — | — | — | 0.0010 | — |
| M | 0.15 | 1.20 | 2.00 | 0.001 | 0.002 | 0.0040 | 0.030 | 0.50 | — | — | — | 0.0010 | — |
| N | 0.15 | 1.20 | 2.00 | 0.001 | 0.002 | 0.0040 | 0.030 | — | 0.20 | — | — | 0.0010 | — |
| O | 0.15 | 1.20 | 2.00 | 0.001 | 0.002 | 0.0040 | 0.030 | — | — | 0.40 | — | 0.0010 | — |
| P | 0.15 | 1.20 | 2.00 | 0.001 | 0.002 | 0.0040 | 0.030 | — | — | — | 0.50 | 0.0010 | — |
| Q | 0.15 | 1.20 | 2.00 | 0.001 | 0.002 | 0.0040 | 0.030 | — | — | — | — | — | 0.0010 |
| R | 0.12 | 1.80 | 2.50 | 0.002 | 0.002 | 0.0040 | 0.030 | — | — | — | — | — | — |
| S | 0.12 | 1.80 | 2.80 | 0.002 | 0.002 | 0.0040 | 0.030 | — | — | — | — | — | — |

(Steel kind C: Missing number, *Out of scope of the invention)

TABLE 2

| | Annealing condition | | | | | |
|---|---|---|---|---|---|---|
| Heat treatment No. | Heating temperature (° C.) | Holding time (s) | First cooling rate (° C./s) | First cooling finishing temperature (° C.) | Second cooling rate (° C./s) | Second cooling finishing temperature (° C.) |
| a | 900 | 120 | 20 | 675 | 200 | 20 |
| b | 900 | 120 | 20 | 580* | 200 | 20 |
| c | 900 | 120 | 20 | 675 | 200 | 20 |
| d | 900 | 120 | 20 | 675 | 200 | 20 |
| e | 900 | 120 | 20 | 675 | 200 | 20 |
| f | 900 | 120 | 20 | 675 | 200 | 20 |
| g | 900 | 120 | 20 | 675 | 200 | 20 |
| h | 800* | 120 | 20 | 675 | 200 | 20 |
| i | 900 | 120 | 20 | 630 | 200 | 20 |

| | Tempering condition | | | | | |
|---|---|---|---|---|---|---|
| Heat treatment No. | Average heating rate (° C./s) | First step heating temperature (° C.) | First step holding time (s) | Second step heating temperature (° C.) | Second step holding time (s) | Parameter: P |
| a | 20 | 350 | 60 | 500 | 180 | $6.9\times 10^{-4}$ |
| b | 20 | 350 | 60 | 500 | 180 | $6.9\times 10^{-4}$ |
| c | 20 | 200* | 60 | 500 | 180 | $6.9\times 10^{-4}$ |
| d | 20 | 450* | 60 | 500 | 180 | $6.9\times 10^{-4}$ |
| e | 20 | 350 | 60 | 400* | 180 | $1.1\times 10^{-4}$ |
| f | 20 | 350 | 60 | 600* | 180 | $2.9\times 10^{-3}$* |
| g | 20 | —* | —* | 500 | 180 | $6.9\times 10^{-4}$ |
| h | 20 | 350 | 60 | 500 | 180 | $6.9\times 10^{-4}$ |
| i | 20 | 350 | 60 | 500 | 180 | $6.9\times 10^{-4}$ |

(*Out of recommended scope)

With respect to the individual steel sheets after the heat treatment, the area fraction and the hardness of the martensite as well as the size and the number of existence of the cementite particles were measured according to the measurement method described in the above-referenced clause of "Best Mode for Carrying Out the Invention".

Also, with respect to the individual steel sheets described above, the tensile strength TS, elongation El, and stretch-flangeability λ were measured. Further, with respect to the tensile strength TS and elongation El, a No. 5 test piece described in JIS Z 2201 was manufactured with arranging the longitudinal axis in the direction orthogonal to the rolling direction, and measurement was performed according to JIS Z 2241. Furthermore, with respect to the stretch-flangeability λ, the hole expansion test was performed and the hole expansion ratio was measured according to the Japan Iron and Steel Federation standards JFST 1001, and it was made stretch-flangeability.

The result of measurement is shown in Table 3.

TABLE 3

| Steel No. | Steel kind | Heat treatment No. | Area fraction of martensite VM (%) | Area fraction of ferrite VF (%) | Area fraction of other structure (%) | Hardness of martensite HvM | Vickers hardness Hv | Hardness of ferrite HvF |
|---|---|---|---|---|---|---|---|---|
| 1 | A | a | 100 | 0 | 0 | 305 | 305 | 130 |
| 2 | B | a | 85 | 15 | 0 | 343 | 325 | 160 |
| 4 | D | a | 40 | 60 | 0 | 286* | 210 | 160 |
| 5 | E | a | 90 | 10 | 0 | 354 | 335 | 160 |
| 6 | F* | a | 90 | 10 | 0 | 383* | 361 | 160 |
| 7 | G | a | 80 | 20 | 0 | 348 | 315 | 181 |
| 8 | H | a | 60 | 40 | 0 | 391* | 318 | 208 |
| 9 | I* | a | 78 | 22 | 0 | 346 | 301 | 140 |
| 10 | J | a | 82 | 18 | 0 | 344 | 309 | 152 |
| 11 | K | a | 98 | 2 | 0 | 333 | 330 | 170 |
| 12 | L* | a | 80 | 0 | 20* | 351 | 321 | 200 |
| 13 | M | a | 90 | 10 | 0 | 347 | 328 | 155 |
| 14 | N | a | 95 | 5 | 0 | 339 | 330 | 160 |
| 15 | O | a | 95 | 5 | 0 | 333 | 325 | 164 |
| 16 | P | a | 95 | 5 | 0 | 336 | 327 | 160 |
| 17 | Q | a | 95 | 5 | 0 | 335 | 326 | 160 |
| 18 | B | b | 40 | 60 | 0 | 411* | 260 | 160 |
| 19 | B | c | 85 | 15 | 0 | 354 | 325 | 160 |
| 20 | B | d | 85 | 15 | 0 | 357 | 327 | 160 |
| 21 | B | e | 85 | 15 | 0 | 385* | 351 | 160 |
| 22 | B | f | 85 | 15 | 0 | 302 | 281 | 160 |
| 23 | B | g | 95 | 5 | 0 | 334 | 325 | 160 |
| 24 | B | h | 35* | 65 | 0 | 475* | 270 | 160 |
| 25 | B | i | 65 | 35 | 0 | 306 | 255 | 160 |
| 26 | R | a | 44 | 56 | 0 | 379 | 265 | 176 |
| 27 | S | a | 43 | 57 | 0 | 321 | 240 | 179 |

| Steel No. | Number of cementite particles of 0.1 μm or more(number/μm$^2$) | Number of cementite particles of 0.02-0.1 μm (number/μm$^2$) | TS (MPa) | El (%) | λ (%) | Remarks |
|---|---|---|---|---|---|---|
| 1 | 2.6 | 10.2 | 996 | 11.0 | 102 | Example of the invention |
| 2 | 1.8 | 23.2 | 1062 | 12.0 | 115 | |
| 4 | 0.5 | 11.5 | 686* | 21.0 | 85* | Comparative example* |
| 5 | 2.8 | 15.2 | 1094 | 10.4 | 104 | Example of the invention |
| 6 | 4.6* | 13.4 | 1179 | 8.0* | 81* | Comparative example* |
| 7 | 0.8 | 23.2 | 1029 | 11.0 | 105 | Example of the invention |
| 8 | 0.4 | 27.6 | 1039 | 13.0 | 71* | Comparative example* |
| 9 | 5.1* | 6.9* | 983 | 12.0 | 80* | |
| 10 | 2.4 | 12.6 | 1009 | 10.4 | 111 | Example of the invention |
| 11 | 1.0 | 14.0 | 1078 | 10.5 | 121 | |
| 12 | 0.5 | 11.5 | 1049 | 10.4 | 71* | Comparative example* |
| 13 | 1.5 | 29.5 | 1071 | 12.7 | 120 | Example of the invention |
| 14 | 1.6 | 27.4 | 1078 | 12.5 | 123 | |
| 15 | 1.9 | 22.1 | 1062 | 12.0 | 119 | |
| 16 | 1.7 | 24.3 | 1068 | 12.1 | 115 | |
| 17 | 1.8 | 23.2 | 1065 | 12.0 | 115 | |
| 18 | 2.1 | 12.9 | 849 | 21.0 | 24* | Comparative example* |
| 19 | 5.2* | 16.8 | 1062 | 12.0 | 75* | |
| 20 | 6.0* | 6.3 | 1068 | 10.2 | 56* | |
| 21 | 1.1 | 5.9* | 1147 | 8.0* | 84* | |
| 22 | 4.3* | 23.7 | 918 | 14.0 | 70* | |
| 23 | 3.8* | 14.2 | 1062 | 11.0 | 90* | |
| 24 | 2.8 | 15.2 | 882 | 15.0 | 40* | |
| 25 | 2.1 | 18.9 | 833 | 17.0 | 110 | Example of the invention |
| 26 | 2.5 | 12.5 | 865 | 17.5 | 115 | Example of the invention |

TABLE 3-continued

| | | | | | | |
|---|---|---|---|---|---|---|
| 27 | 1.8 | 19.3 | 795 | 20.3 | 109 | Example of the invention |

(Steel No. 3: Missing number, *Out of scope of the invention)

As shown in Table 3, in all of the steel Nos. 1-2, 5, 7, 10, 11, 13-17, 25-27 which are the examples according to an embodiment of the present invention, when the tensile strength TS is 780 MPa or more, elongation El is 15% or more and stretch-flangeability (hole expansion ratio) λ satisfies 100% or more, whereas when the tensile TS is 980 MPa or more, elongation El is 10% or more and stretch-flangeability (hole expansion ratio) λ satisfies 100% or more. Therefore, a high strength cold rolled steel sheet having both elongation and stretch-flangeability that satisfies the requirement level described in the above-referenced clause of "Background Art" was secured.

On the other hand, the steel Nos. 4, 6, 8, 9, 12, 19-24 which are the comparative examples are inferior in any of performances.

For example, the steel No. 4 is excellent in elongation because the hardness of the martensite is less than 300 Hv, however is inferior in tensile strength and stretch-flangeability.

Also, the steel No. 6 is excellent in tensile strength but inferior in both elongation and stretch-flangeability because C content is too high therefore the area fraction of martensite is 50% or more however the hardness is too high and the coarsened cementite particles become too many.

Also, the steel No. 8 is excellent in tensile strength and elongation but inferior in stretch-flangeability because the area fraction of martensite is 50% or more however the hardness is too high.

Also, the steel No. 9 is excellent in tensile strength and elongation but inferior in stretch-flangeability because the cementite particles become coarse as Mn content is too low.

Also, the steel No. 12 is excellent in tensile strength and elongation but inferior in stretch-flangeability because the austenite remains in quenching (in cooling after heating for annealing) as Mn content is too high.

Also, the steel Nos. 18-24 are excellent in tensile strength but inferior in at least one of elongation and stretch-flangeability because at least one of the requirements deciding the structure according to an embodiment of the present invention is not satisfied as the annealing condition or the tempering condition is out of the recommended scope.

In this connection, the distribution state of the cementite particles in the martensite structure of the example according to an embodiment of the present invention (steel No. 2) and the comparative example (steel No. 19) are exemplarily exhibited in FIGS. 1 and 2. FIG. 1 is the result of the observation by a SEM and the white portion is the cementite particle. Also, FIG. 2 is the distribution of the grain diameters (equivalent-circle diameters) of the cementite particles in the cementite structure shown by a histogram. As is clear from the figures, it is recognized that the fine cementite particles are evenly dispersed in the example according to an embodiment of the present invention whereas many coarsened cementite particles are present in the comparative example.

Embodiment Related to a Steel Sheet of the Second Aspect

Steel with the components shown in Table 4 below was smelted, and an ingot with 120 mm thickness was manufactured. It was hot rolled to the thickness of 25 mm, and thereafter was hot rolled again to the thickness of 3.2 mm. It was acid washed, was cold rolled thereafter to the thickness of 1.6 mm to make the sample material, and was subjected to heat treatment under the condition shown in Table 5.

TABLE 4

(Component: mass %)

| Steel kind | C | Si | Mn | P | S | N | Al | Cr | Mo | Cu | Ni | Ca | Mg | Ac3 (° C.) | (Ac1 + Ac3)/2 (° C.) |
|---|---|---|---|---|---|---|---|---|---|---|---|---|---|---|---|
| A' | 0.15 | 0.10 | 2.07 | 0.001 | 0.002 | 0.004 | 0.031 | — | — | — | — | — | — | 836 | 770 |
| B' | 0.15 | 1.21 | 2.02 | 0.001 | 0.002 | 0.004 | 0.031 | — | — | — | — | 0.0010 | — | 885 | 811 |
| D' | 0.01 | 1.24 | 2.07 | 0.001 | 0.002 | 0.004 | 0.031 | — | — | — | — | 0.0010 | — | 945 | 841 |
| E' | 0.26 | 1.22 | 2.04 | 0.001 | 0.002 | 0.004 | 0.031 | — | — | — | — | 0.0010 | — | 861 | 799 |
| F' | 0.41* | 1.23 | 2.02 | 0.001 | 0.002 | 0.004 | 0.031 | — | — | — | — | 0.0010 | — | 835 | 786 |
| G' | 0.15 | 1.88 | 2.08 | 0.001 | 0.002 | 0.004 | 0.030 | — | — | — | — | 0.0010 | — | 915 | 835 |
| H' | 0.16 | 3.10* | 2.05 | 0.001 | 0.002 | 0.004 | 0.031 | — | — | — | — | 0.0010 | — | 967 | 879 |
| I' | 0.15 | 1.22 | 0.05* | 0.001 | 0.002 | 0.004 | 0.031 | — | — | — | — | 0.0010 | — | 886 | 822 |
| J' | 0.15 | 1.24 | 1.23 | 0.001 | 0.002 | 0.004 | 0.031 | — | — | — | — | 0.0010 | — | 887 | 816 |
| K' | 0.15 | 1.22 | 3.02 | 0.001 | 0.002 | 0.004 | 0.031 | — | — | — | — | 0.0010 | — | 886 | 806 |
| L' | 0.15 | 1.25 | 6.25* | 0.001 | 0.002 | 0.004 | 0.031 | — | — | — | — | 0.0010 | — | 887 | 790 |
| M' | 0.15 | 1.23 | 2.08 | 0.001 | 0.002 | 0.004 | 0.031 | 0.50 | — | — | — | 0.0010 | — | 886 | 816 |
| N' | 0.16 | 1.22 | 2.04 | 0.001 | 0.002 | 0.004 | 0.031 | — | 0.20 | — | — | 0.0010 | — | 890 | 813 |
| O' | 0.15 | 1.24 | 2.02 | 0.001 | 0.002 | 0.004 | 0.031 | — | — | 0.40 | — | 0.0010 | — | 887 | 812 |
| P' | 0.15 | 1.23 | 2.02 | 0.001 | 0.002 | 0.004 | 0.030 | — | — | — | 0.50 | 0.0010 | — | 879 | 804 |
| Q' | 0.15 | 1.24 | 2.09 | 0.001 | 0.002 | 0.004 | 0.030 | — | — | — | — | — | 0.0010 | 887 | 812 |

(Steel kind C': Missing number, *Out of scope of the invention)

TABLE 5

| Heat treatment No. | Annealing condition: Heating temperature (° C.) | Reannealing condition: Heating temperature (° C.) | Holding time (s) | First cooling rate (° C./s) | First cooling finishing temperature (° C.) | Second cooling rate (° C./s) | Second cooling finishing temperature (° C.) |
|---|---|---|---|---|---|---|---|
| a' | 920 | 900 | 120 | 20 | 675 | 200 | 20 |
| b' | 920 | 900 | 120 | 20 | 580* | 200 | 20 |
| c' | 920 | 900 | 120 | 20 | 675 | 200 | 20 |
| d' | 920 | 900 | 120 | 20 | 675 | 200 | 20 |
| e' | 920 | 900 | 120 | 20 | 675 | 200 | 20 |
| f' | 920 | 900 | 120 | 20 | 675 | 200 | 20 |
| g' | 920 | 900 | 120 | 20 | 675 | 200 | 20 |
| h' | 920 | 800* | 120 | 20 | 675 | 200 | 20 |
| i' | 920 | 900 | 120 | 20 | 630 | 200 | 20 |
| j' | None* | 900 | 120 | 20 | 675 | 200 | 20 |
| k' | 820* | 900 | 120 | 20 | 675 | 200 | 20 |

| Heat treatment No. | Tempering condition: Average heating rate (° C./s) | First step heating temperature (° C.) | First step holding time (s) | Second step heating temperature (° C.) | Second step holding time (s) | Parameter: Pg | Parameter: Pt |
|---|---|---|---|---|---|---|---|
| a' | 20 | 350 | 60 | 500 | 180 | $6.9 \times 10^{-4}$ | $1.49 \times 10^{4}$ |
| b' | 20 | 350 | 60 | 500 | 180 | $6.9 \times 10^{-4}$ | $1.49 \times 10^{4}$ |
| c' | 20 | 200* | 60 | 500 | 180 | $6.9 \times 10^{-4}$ | $1.49 \times 10^{4}$ |
| d' | 20 | 450* | 60 | 500 | 180 | $6.9 \times 10^{-4}$ | $1.49 \times 10^{4}$ |
| e' | 20 | 350 | 60 | 400* | 180 | $1.1 \times 10^{-4}$ | $1.30 \times 10^{4}$ |
| f' | 20 | 350 | 60 | 600* | 180 | $2.9 \times 10^{-3}$* | $1.68 \times 10^{4}$ |
| g' | 20 | —* | —* | 500 | 180 | $6.9 \times 10^{-4}$ | $1.49 \times 10^{4}$ |
| h' | 20 | 350 | 60 | 500 | 180 | $6.9 \times 10^{-4}$ | $1.49 \times 10^{4}$ |
| i' | 20 | 350 | 60 | 500 | 180 | $6.9 \times 10^{-4}$ | $1.49 \times 10^{4}$ |
| j' | 20 | 350 | 60 | 500 | 180 | $6.9 \times 10^{-4}$ | $1.49 \times 10^{4}$ |
| k' | 20 | 350 | 60 | 500 | 180 | $6.9 \times 10^{-4}$ | $1.49 \times 10^{4}$ |

(*Out of recommended scope)

With respect to the individual steel sheets after the heat treatment, the area fraction and the hardness of the martensite as well as the size and the number of existence of the cementite particles were measured according to the measurement method described in the above-referenced clause of "Best Mode for Carrying Out the Invention".

Also, with respect to the individual steel sheets described above, the tensile strength TS, elongation $El_L$ in L direction (rolling direction) and elongation $El_C$ in C direction (the direction orthogonal to the rolling direction), as well as stretch-flangeability λ were measured. Further, with respect to the tensile strength TS and elongation, No. 5 test pieces described in JIS Z 2201 were manufactured with arranging the longitudinal axis in the direction orthogonal to the rolling direction for elongation $El_C$ in C direction and with arranging the longitudinal axis along the rolling direction for elongation $El_L$, in L direction respectively, and measurement was performed according to JIS Z 2241. Also, the difference of the elongation in the L direction and C direction $\Delta El = El_L - El_C$ was calculated, and the one in which ΔEl is below 1% was made to have passed as the one having small anisotropy of elongation. Furthermore, with respect to the stretch-flangeability λ, the hole expansion test was performed and the hole expansion ratio was measured according to the Japan Iron and Steel Federation standards JFST 1001, and it was made stretch-flangeability.

The result of measurement is shown in Table 6.

TABLE 6

| Steel No. | Steel kind | Heat treatment No. | Area fraction of martensite VM (%) | Area fraction of ferrite VF (%) | Area fraction of other structure (%) | Hardness of martensite HvM | Vickers hardness Hv | Hardness of ferrite HvF |
|---|---|---|---|---|---|---|---|---|
| 28 | A' | a' | 100 | 0 | 0 | 308 | 308 | 130 |
| 29 | B' | a' | 85 | 15 | 0 | 355 | 326 | 162 |
| 31 | D' | a' | 40 | 60 | 0 | 286* | 211 | 161 |
| 32 | E' | a' | 88 | 12 | 0 | 361 | 337 | 161 |
| 33 | F'* | a' | 90 | 10 | 0 | 387* | 364 | 161 |
| 34 | G' | a' | 80 | 20 | 0 | 353 | 318 | 177 |
| 35 | H'* | a' | 30 | 70 | 0 | 390* | 318 | 211 |
| 36 | I'* | a' | 78 | 22 | 0 | 349 | 303 | 141 |
| 37 | J' | a' | 82 | 18 | 0 | 346 | 311 | 153 |
| 38 | K' | a' | 98 | 2 | 0 | 333 | 330 | 171 |
| 39 | L'* | a' | 80 | 0 | 20* | 368 | 335 | 203 |
| 40 | M' | a' | 90 | 10 | 0 | 348 | 329 | 155 |
| 41 | N' | a' | 95 | 5 | 0 | 340 | 331 | 161 |
| 42 | O' | a' | 95 | 5 | 0 | 337 | 328 | 166 |
| 43 | P' | a' | 95 | 5 | 0 | 336 | 327 | 161 |
| 44 | Q' | a' | 95 | 5 | 0 | 338 | 329 | 161 |
| 45 | B' | b' | 40 | 60 | 0 | 413* | 262 | 162 |
| 46 | B' | c' | 85 | 15 | 0 | 357 | 328 | 162 |

TABLE 6-continued

| | | | | | | | | |
|---|---|---|---|---|---|---|---|---|
| 47 | B' | d' | 85 | 15 | 0 | 356 | 327 | 162 |
| 48 | B' | e' | 85 | 15 | 0 | 387* | 353 | 162 |
| 49 | B' | f' | 85 | 15 | 0 | 304 | 283 | 162 |
| 50 | B' | g' | 85 | 15 | 0 | 356 | 327 | 162 |
| 51 | B' | h' | 35* | 65 | 0 | 474* | 271 | 162 |
| 52 | B' | i' | 65 | 35 | 0 | 308 | 257 | 162 |
| 53 | B' | j' | 90 | 10 | 0 | 338 | 320 | 162 |
| 54 | B' | k' | 86 | 14 | 0 | 349 | 323 | 162 |

| Steel No. | Number of cementite particles of 0.1 μm or more (number/μm$^2$) | Maximum degree of integration of (110) α | TS (MPa) | $El_L$ (%) | $El_C$ (%) | Δ El (%) | λ (%) | Remarks |
|---|---|---|---|---|---|---|---|---|
| 28 | 2.6 | 1.42 | 988 | 12.3 | 12.8 | 0.5 | 103 | Example of |
| 29 | 1.8 | 1.40 | 1078 | 10.4 | 10.7 | 0.3 | 117 | the invention |
| 31 | 0.5 | 1.81* | 684* | 20.0 | 21.3 | 1.3* | 85* | Comparative example* |
| 32 | 2.8 | 1.37 | 1123 | 10.9 | 11.1 | 0.2 | 109 | Example of the invention |
| 33 | 4.6* | 1.39 | 1211 | 12.7 | 13.1 | 0.4 | 85* | Comparative example* |
| 34 | 0.8 | 1.48 | 1037 | 10.2 | 10.8 | 0.6 | 105 | Example of the invention |
| 35 | 0.4 | 1.43 | 752 | 11.6 | 12.1 | 0.5 | 71* | Comparative |
| 36 | 5.1* | 1.35 | 1004 | 12.3 | 12.5 | 0.2 | 83* | example* |
| 37 | 2.4 | 1.43 | 1033 | 12.0 | 12.3 | 0.3 | 112 | Example of |
| 38 | 1.0 | 1.50 | 1092 | 10.2 | 10.8 | 0.6 | 126 | the invention |
| 39 | 0.5 | 1.50 | 1094 | 10.7 | 11.4 | 0.7 | 73* | Comparative example* |
| 40 | 1.5 | 1.37 | 1065 | 12.9 | 13.2 | 0.3 | 124 | Example of |
| 41 | 1.6 | 1.34 | 1099 | 12.1 | 12.2 | 0.1 | 124 | the invention |
| 42 | 1.9 | 1.36 | 1062 | 12.8 | 13.1 | 0.3 | 120 | |
| 43 | 1.7 | 1.33 | 1053 | 12.1 | 12.4 | 0.3 | 120 | |
| 44 | 1.8 | 1.47 | 1083 | 10.6 | 11.1 | 0.5 | 120 | |
| 45 | 2.1 | 1.51 | 857 | 18.0 | 18.6 | 0.6 | 24* | Comparative |
| 46 | 5.2* | 1.38 | 1077 | 11.8 | 12.1 | 0.3 | 78* | example* |
| 47 | 6.0* | 1.30 | 1079 | 11.1 | 11.3 | 0.2 | 59* | |
| 48 | 1.1 | 1.46 | 1133 | 7.4 | 7.9 | 0.5 | 84* | |
| 49 | 4.3* | 1.51 | 936 | 14.9 | 15.6 | 0.7 | 72* | |
| 50 | 3.8* | 1.36 | 1080 | 12.0 | 12.3 | 0.3 | 91* | |
| 51 | 2.8 | 1.50 | 877 | 14.0 | 14.7 | 0.7 | 40* | |
| 52 | 2.1 | 1.33 | 828 | 17.5 | 17.6 | 0.1 | 113 | Example of the invention |
| 53 | 2.1 | 1.87* | 1047 | 10.2 | 11.7 | 1.5* | 115 | Reference |
| 54 | 2.1 | 1.78* | 1060 | 11.8 | 13.1 | 1.3* | 119 | example* |

(Steel No. 30: Missing number, *Out of scope of the invention)

As shown in Table 6, in all of the steel Nos. 28, 29, 32, 34, 37, 38, 40-44, 52 which are the examples according to an embodiment of the present invention, when the tensile strength TS is 780 MPa or more, elongation is 15% or more and stretch-flangeability (hole expansion ratio) λ satisfies 100% or more, whereas when the tensile TS is 980 MPa or more, elongation El is 10% or more and stretch-flangeability (hole expansion ratio) λ satisfies 100% or more. Also, the examples according to an embodiment of the present invention described above has small anisotropy of elongation, and a high strength cold rolled steel sheet having all of isotropy, both elongation and stretch-flangeability that satisfy the requirement level described in the above-referenced clause of "Background Art" was secured.

On the other hand, the steel Nos. 31, 33, 35, 36, 39, 45-51 which are the comparative examples are inferior in any of performances.

For example, the steel No. 31 is excellent in elongation because the hardness of the martensite is less than 300 Hv, however it is inferior in tensile strength and stretch-flangeability, and anisotropy of elongation is large because the maximum degree of integration of (110)α exceeds 1.7.

Also, the steel No. 33 is excellent in tensile strength and having small anisotropy of elongation but inferior in both an absolute value of elongation and stretch-flangeability because C content is too high therefore the area fraction of the martensite is 50% or more however the hardness becomes too high and the coarsened cementite particles become too many.

Also, the steel No. 35 is excellent in tensile strength and elongation as well as having small anisotropy of elongation but inferior in stretch-flangeability because the area fraction of the martensite becomes less than 50% and the hardness is too high as Si content is too high.

Also, the steel No. 36 is excellent in tensile strength and elongation as well as having small anisotropy of elongation but inferior in stretch-flangeability because the cementite particles become coarse as Mn content is too low.

Also, the steel No. 39 is excellent in tensile strength and elongation as well as having small anisotropy of elongation but inferior in stretch-flangeability because the austenite remains in quenching (in cooling after heating for annealing) as Mn content is too high.

Also, the steel Nos. 45-51 are excellent in tensile strength and having small anisotropy of elongation but inferior at least in stretch-flangeability because the requirements deciding the hardness of the martensite or the dispersion state of the cementite particles are not satisfied as the reannealing condition or the tempering condition is out of the recommended scope.

Further, the steel Nos. 53, 54 are the reference examples. These steels are the examples which are excellent in tensile strength, the absolute value of elongation as well as stretch-flangeability and satisfy the requirement level described in the above-referenced clause of "Background Art", however do not satisfy the requirement deciding the degree of integration of (110)α, and in which only anisotropy of elongation becomes large because the annealing condition is out of the recommended scope.

Figure 3:
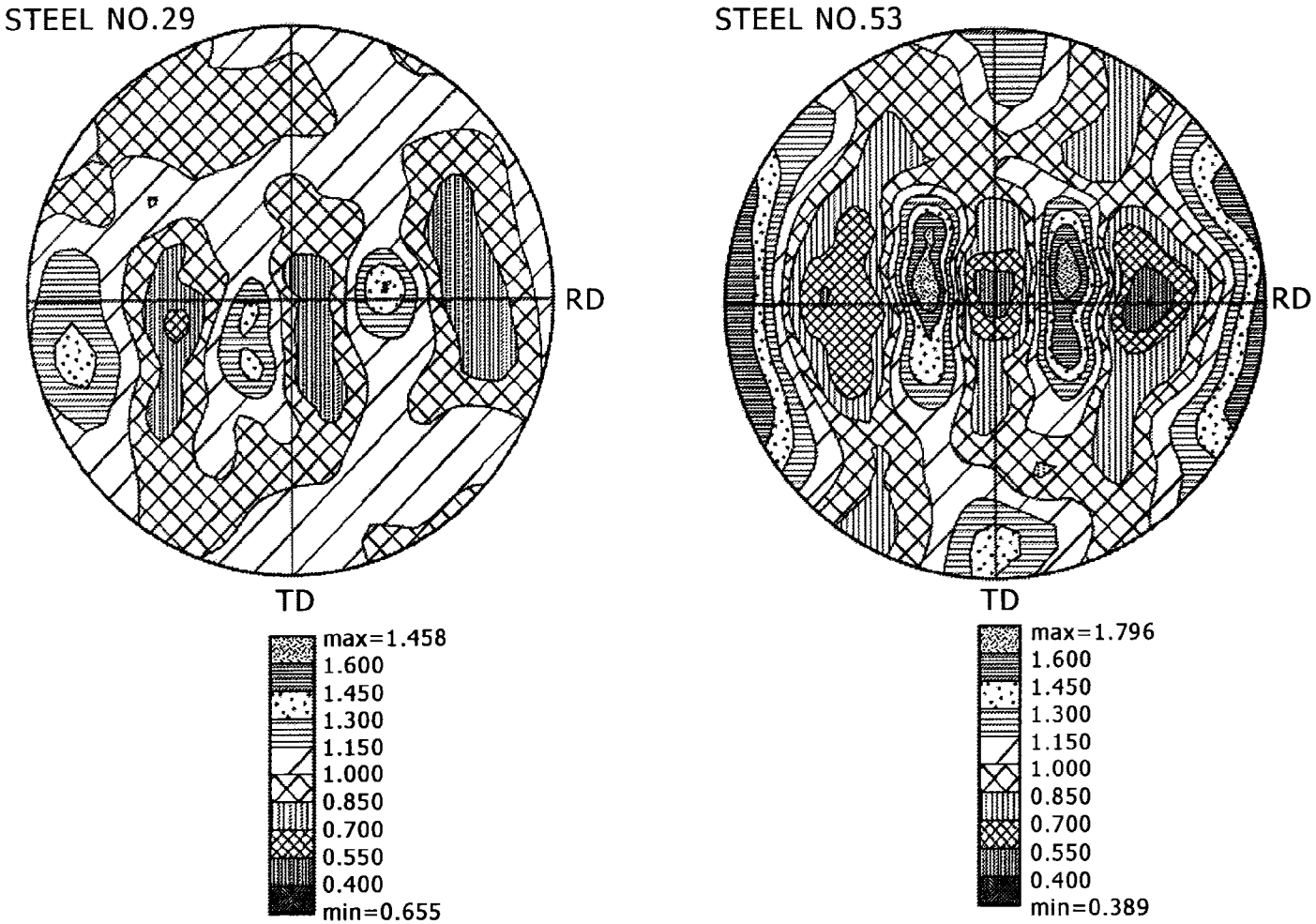
FIG. 3 A pole figure of (110) crystal plane of the ferrite of an example of the invention (steel No. 29) of an embodiment related with the steel sheet according to the second aspect of the present application and a comparative example (steel No. 53).

In this connection, pole figures of (110)α by the FM method of the example according to an embodiment of the present invention (steel No. 29) and the comparative example (steel No. 53) are exemplarily shown in FIG. 3. It is recognized that anisotropy obviously becomes small in the example according to an embodiment of the present invention compared to the comparative example.

Although the present invention was described in detail referring to specific aspects as above, it is obvious for a person with an ordinal skill in the art that a variety of alterations and modifications can be added without departing from the spirit and scope of the present invention. The present application is based on the Japanese Patent Application No. 2007-303510 applied on Nov. 22, 2007 and the Japanese Patent Application No. 2007-303511 applied on Nov. 22, 2007, the content of which is hereby incorporated by reference into this application.

The invention claimed is:

1. A high-strength cold-rolled steel sheet having a componential composition comprising:

Fe and unavoidable impurities;

C: 0.12-0.30 mass %;

Si: 0.1-3.0 mass %;

Mn: 0.1-5.0 mass %;

P: 0.1 mass % or below;

S: 0.005 mass % or below;

N: 0.01 mass % or below; and

Al: 0.01-1.00 mass %;

wherein:

the sheet has a structure comprising from 70 to 100%, in terms of area fraction, of tempered martensite having a hardness of 300 to 380 Hv, with a balance being ferrite; and cementite particles in the tempered martensite are dispersed such that:

10 or more cementite particles having equivalent-circle diameters of 0.02 μm or more and less than 0.1 μm are present per one $\mu m^2$ of the tempered martensite; and three or fewer cementite particles having equivalent-circle diameters of 0.1 μm or above are present per one $\mu m^2$ of the tempered martensite.

2. A high-strength cold-rolled steel sheet having a componential composition comprising:

Fe and unavoidable impurities;

C: 0.12-0.30 mass %;

Si: 0.1-3.0 mass %;

Mn: 0.1-5.0 mass %;

P: 0.1 mass % or below;

S: 0.005 mass % or below;

N: 0.01 mass % or below; and

Al: 0.01-1.00 mass %;

wherein a structure comprises at least 40%, up to 100%, in terms of area fraction of tempered martensite having a hardness of 300 to 380 Hv with the balance being ferrite;

cementite particles in the tempered martensite take such dispersion that three or fewer cementite particles having equivalent-circle diameters of 0.1 μm or above are present per one $\mu m^2$ of the tempered martensite; and the maximum degree of integration of (110) crystal plane in the ferrite is 1.7 or less.

3. The high-strength cold-rolled steel sheet according to claim 1, further comprising at least one of Cr: 0.01-1.0 mass % and Mo: 0.01-1.0 mass %.

4. The high-strength cold-rolled steel sheet according to claim 1, further comprising at least one of Cu: 0.05-1.0 mass % and Ni: 0.05-1.0 mass %.

5. The high-strength cold-rolled steel sheet according claim 1, further comprising at least one of Ca: 0.0005-0.01 mass % and Mg: 0.0005-0.01 mass %.

6. The high-strength cold-rolled steel sheet according to claim 2, further comprising at least one of Cr: 0.01-1.0 mass % and Mo: 0.01-1.0 mass %.

7. The high-strength cold-rolled steel sheet according to claim 2, further comprising at least one of Cu: 0.05-1.0 mass % and Ni: 0.05-1.0 mass %.

8. The high-strength cold-rolled steel sheet according to claim 2, further comprising at least one of Ca: 0.0005-0.01 mass % and Mg: 0.0005-0.01 mass %.

9. The high-strength cold-rolled steel sheet according to claim 3, further comprising at least one of Cu: 0.05-1.0 mass % and Ni: 0.05-1.0 mass %.

10. The high-strength cold-rolled steel sheet according to claim 3, further comprising at least one of Ca: 0.0005-0.01 mass % and Mg: 0.0005-0.01 mass %.

11. The high-strength cold-rolled steel sheet according to claim 4, further comprising at least one of Ca: 0.0005-0.01 mass % and Mg: 0.0005-0.01 mass %.

* * * * *